United States Patent [19]

Carini et al.

[11] Patent Number: 4,688,033

[45] Date of Patent: Aug. 18, 1987

[54] MERGED DATA STORAGE PANEL DISPLAY

[75] Inventors: Richard P. Carini, Kingston; James A. Donnelly; Joseph J. Ellis, Jr., both of West Hurley; Thomas P. Lanzoni, Kingston, all of N.Y.

[73] Assignee: International Business Machines Corporation, Armonk, N.Y.

[21] Appl. No.: 664,663

[22] Filed: Oct. 25, 1984

[51] Int. Cl.[4] ..... G09G 3/00

[52] U.S. Cl. ..... 340/800; 340/799; 340/781; 340/776

[58] Field of Search ..... 340/798, 799, 800, 709, 340/781, 771–776

[56] References Cited

U.S. PATENT DOCUMENTS

| | | | |
|---|---|---|---|
| 4,201,983 | 5/1980 | Magerl et al. | 340/709 |
| 4,278,974 | 7/1981 | Kondo | 340/798 |
| 4,533,910 | 8/1985 | Sukonick et al. | 340/798 |

*Primary Examiner*—Marshall M. Curtis

*Attorney, Agent, or Firm*—Frederick D. Poag

[57] ABSTRACT

A multi-window display station having main frame (host) interactive and local personal computer display data buffers is provided. The outputs of the two data buffers are merged, using a row or swath buffer, according to default or escape codes stored in one of the data buffers and the combined output drives a plasma panel display. Registers for modified data tags and for presence/absence of escape codes speed the panel update process. Means are included to provide alphanumeric and graphic windows together on the panel screen.

9 Claims, 9 Drawing Figures

| MAPPED BUFFER | MODE | GROUP |
|---|---|---|
| 12 OR 14 | A/N | 8 CHAR. OR 4 CHAR. CODE + CHAR. ATTRIBUTES |
| 14 ONLY | APA | 64 PELS |

EXAMPLE OF A BUFFER MERGE OPERATION $A_{19}$ = MSB, $A_0$ = LSB

MERGED DATA STORAGE PANEL DISPLAY

BACKGROUND OF THE INVENTION

This invention relates to information display apparatus, and more particularly to an improved display station providing presentation of alpha numeric and/or graphic information from plural sources in flexibly locatable windows on a plasma panel or other storage-type display device.

PRIOR ART

Large scale plasma panel (so called gas panel) devices can provide display of a multitude of characters, e.g. up to about ten thousand, in a bright clear fashion. Such devices are also useful for display of so-called all-points addressable graphic material. U.S. patent application Ser. Nos. 472,776, 472,783, and 472,784, filed Mar. 7, 1983, (now respectively U.S. Pats. Nos. 4,566,005 and 4,566,004 issued Jan. 21, 1986, and 4,562,450 issued Dec. 31, 1985) describe a host computer connected keyboard display device capable of showing data from different sources, such as different host sessions or locally copied data, in different quadrants of a large plasma panel display screen.

The art also includes display stations in which alphanumeric and/or graphic data from plural sources can be shown in "windows" which can be sized, moved, and lapped at will in a highly flexible manner. A system of this kind can be constructed using the architecture described in U.S. patent application Ser. Nos. 542,572 filed Oct. 17, 1983 (U.S. Pat. No. 4,653,020 issued Mar. 27, 1987), 542,376 filed Oct. 17, 1983 (U.S. Pat. No. 4,651,146 issued Mar. 17, 1987), and Ser. No. 582,202 filed Feb. 21, 1984. The embodiments described in detail in those applications utilize cathode ray tube (CRT) devices. For operation of the CRT in a flicker-free manner, refresh buffer means are provided. To facilitate handling plural sources, particularly disparate sources such as large host or "main-frame" and local "personal computer" sources, plural buffers are provided, together with a steering or "default" scheme whereby, for a given position on the screen, the data shown is derived from a selected one of the buffers. This provides a very adaptable display station organization.

SUMMARY OF THE INVENTION

It is a general object of the invention to provide a display station which brings together desirable attributes of plasma panel display and multi-buffer display technologies above described so as to provide a work station having advantages of each. Desirably, as much as possible of the pre-existing technology is utilized so that existing display window control and application programs, and plasma panel display devices, remain relevant.

Migration from an architecture scheme designed for CRT buffer arrangements which merge data flow to the CRT repetitively at the CRT refresh rate to one which would provide a merged drive better adapted to the needs of a more slowly written but flicker free plasma panel is facilitated by the invention.

According to one aspect of the invention, data from the plural screen buffers are merged on a pel swath or character row basis (or segment thereof) compatible with the erase-write mechanism of the display panel. This is accomplished by use of a mask register means which records the location of control or "escape" characters in one buffer which indicate that information from the other buffer is to be employed in determining the pels to be displayed at the corresponding locations in the swath. The detection of the escape characters is accomplished during the loading of a row buffer with characters from one buffer. The row buffer is then overwritten with characters from the other buffer at the positions dictated by the mask register.

According to another aspect of the invention, means are provided to determine whether the swath read from the first buffer contains an escape character, and if not, to bypass the over-writing step.

According to yet another aspect of the invention, means are provided to indicate those rows or swaths of the display screen which require updating and to limit the foregoing operations to only those swaths or rows.

According to still another aspect of the invention, one of the buffers can accommodate either character codes or uncoded graphic pel data, and a procedure is provided to updata the plasma panel in accordance thereof.

Other objects and advantages will be evident from the foregoing, and the specification as a whole.

DETAILED DESCRIPTION

Figure 1:
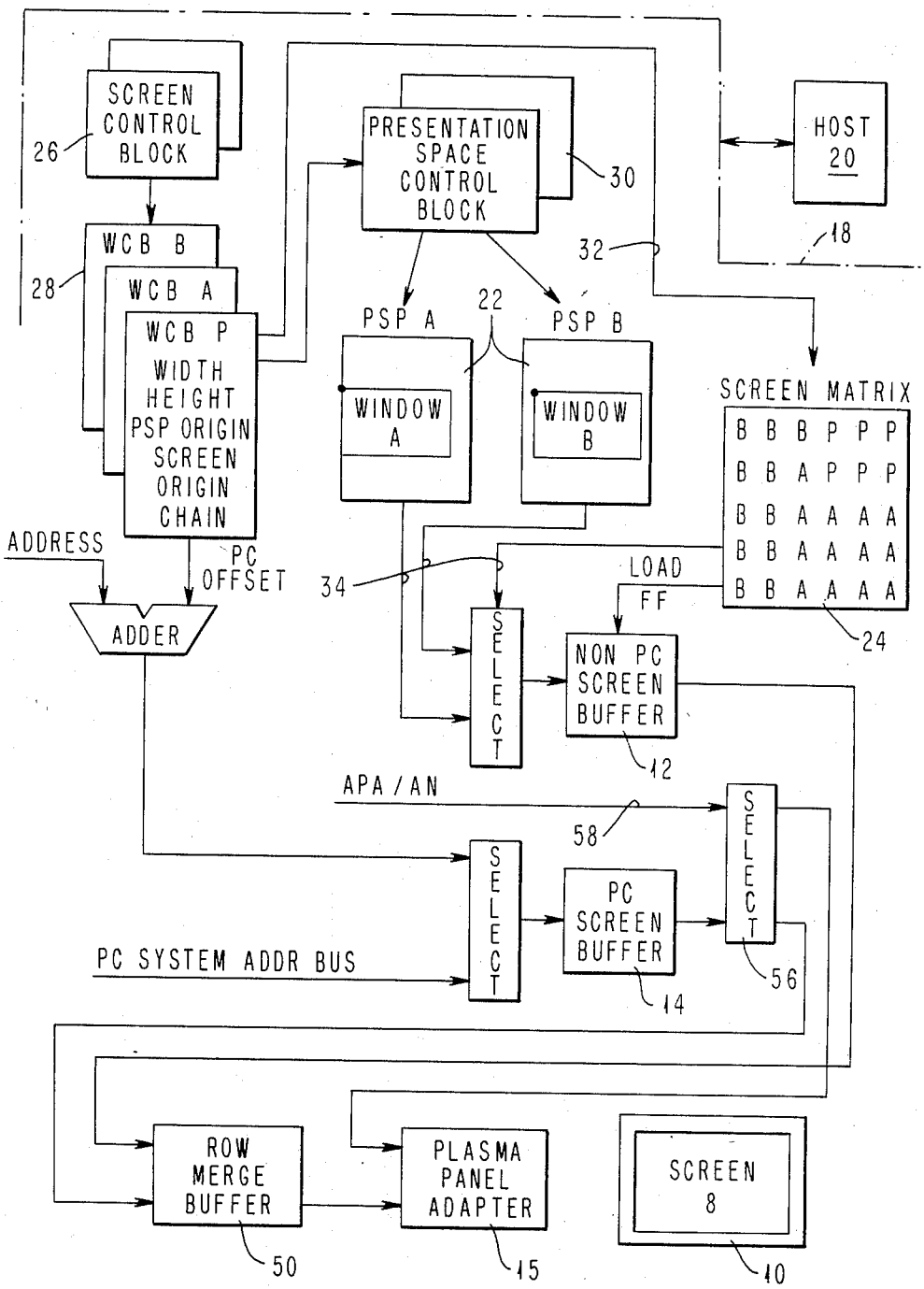
FIG. 1 is a schematic representation of a display apparatus embodying the invention.

FIG. 1 shows a display system having plural data sources which can contribute image information for assembly in a composite image on the display screen 8 of a plasma panel unit 10. In the system shown, the information to be displayed comes from two buffers 12, 14 which contribute information in coded form for decoding by means included in an adapter 15 which drives the panel unit 10.

In the system shown, the buffers 12, 14 are loaded with display data from various sources. In the illustrated system, one buffer 14, receives information from a local personal computer 18 and therefore will be referred to as the PC screen buffer and the other buffer 12 contains display information derived from a main frame computer or host 20 and therefore will be referred to as the MFI screen buffer. The host provided information is assembled in the system in presentation spaces A and B shown at 22 in FIG. 1, and windows of such information, shown as window A and window B are loaded on a character basis into MFI buffer 12 under the control of a screen matrix 24 having a window identifying code position for each of the so-called character box positions at which characters can be shown on the screen 8 of the unit 10. In the simplified showing of FIG. 1, the character boxes are represented by rows and columns of code positions in which codes, shown as letters A and B in FIG. 1, are recorded for indicating the source of the character codes to be loaded into the MFI screen buffer 12 from windows A and B of presentation spaces A and B.

The screen matrix 24 also includes codes, shown as P in FIG. 1, indicative of character positions on the unit 10 screen to be occupied by information derived from the personal computer 18 via buffer 14.

The entire operation of loading the buffers 12 and 14, the presentation spaces 22, and the screen matrix 24 is under the control of the processor in the personal computer 18. In the illustrated embodiment, the computer 18 operates under the control of one or more screen control blocks 26 which sets up a set of window control blocks 28, which via a presentation space control block 30 define the boundaries of the data in presentation spaces A and B constituting windows A and B in 22 and also, via the relationship indicated at 32, set up the screen matrix 24 by which the window data from 22 can be loaded into MFI buffer 12 as indicated at 34. Wherever one of the window control blocks designates that display information from the personal computer 18 is to be shown, the screen matrix 24 is loaded with a code, shown as a P in FIG. 1, to indicate that fact. The result is that a code hex 'FF' is loaded in the 8-bit byte position in the MFI screen buffer 12 representative of the position on the screen 8 of unit 10 corresponding to the position of the "P" in screen matrix 24.

The system of FIG. 1 as thus far described is similar to the alpha-numeric information source facilities described in the aforecited application Ser. No. 582,202. However, in the case of the present invention, the read out and merger of the information from buffers 12 and 14 is performed on a character row or swath basis through the agency of a row buffer 50, a mask register 52 and associated logic 54. Since the PC screen buffer 14 can contain either coded character data or literal pel data (for all points addressable "APA" graphics), a select mechanism 56 is provided to bypass the row buffer 50 for part of its operation, as will be described. Selector 56 is controlled by the personal computer 18 as indicated at 58.

Figure 2:
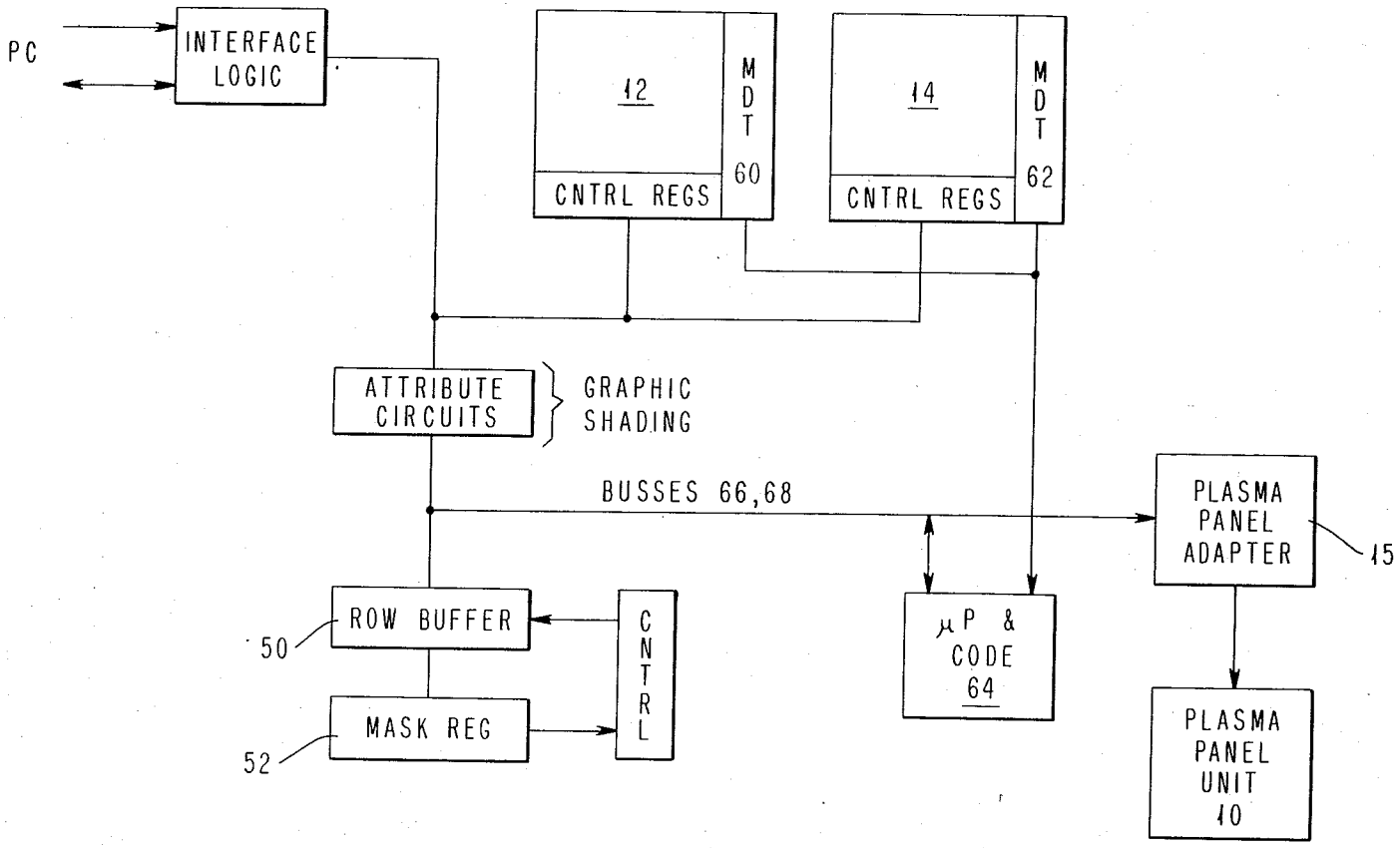
FIG. 2 is a schematic diagram of a row or swath buffer arrangement suitable for employment in the scheme of FIG. 1.
Figure 3:
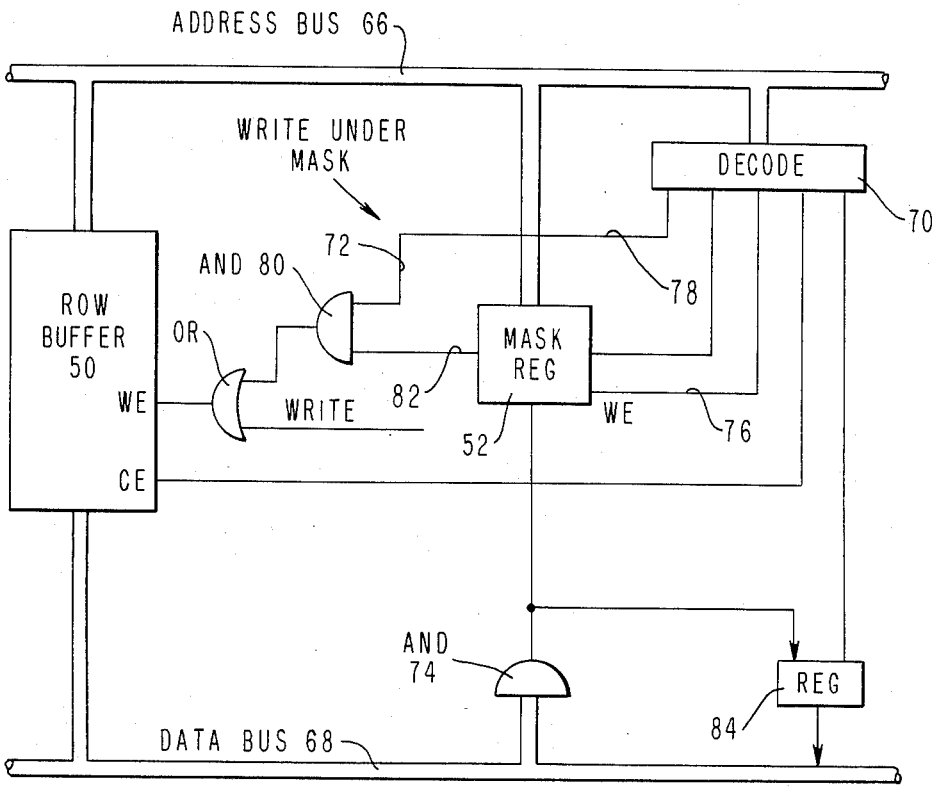
FIG. 3 shows a detail of the logic of FIG. 2.

FIGS. 2 and 3 illustrate in further detail the data flow from the buffers 12, 14 to and through the row buffer 50. The screen buffers 12, 14 each have associated therewith a modified data tag register (MDT) represented at 60, 62 which, through the agency a processor 64, cause modified data to be read a segment at a time to the row buffer 50. The segments thus operated upon are ones containing or associated with data which has been modified and each constitutes a group of adjacent character codes or "APA" bytes, or escape codes in a given display row or swath.

FIG. 3 shows schematically the process by which the row buffer 50 is loaded first with a row or row segment of character codes from the MFI buffer 12 and then over-written by character codes from the PC buffer 14 under control of the mask register 52. Since the screen of the panel unit 10 can accommodate lengthy rows of characters, for example rows 160 characters long, it is convenient to embody the row buffer in a 256 byte read/write (RAM) memory and the associated mask register 52 in a 256×1 bit memory, each connected in conventional fashion to an address bus 66 and a data bus 68 for utilization under the control of the processor 64 shown in FIG. 2. Three address spaces are allotted to row buffer 50. First set address '00000' through '0FFFF' access buffer 50 in a normal manner; Second set address '10000' through '17FFF' are decoded at 70 to enable writing to mask register 52; Third set address '18000' through '1FFFF' are decoded at 70 to enable write under mask line 72.

Under the control of its microcode contained a read-only storage (ROS), the processor 64 addresses each data segment, in sequence, in the buffers 12, 14 wherein a byte in either the MFI buffer 12 or the PC buffer 14 has been modified (as signified by the contents of the modified data tag registers 60, 62, FIG. 1). First, the data is read from the MFI buffer 12 and written into the row buffer 50 using an address of the second set. Simultaneously any 'FF' data byte on data bus 68 will enable AND 74 and write a bit in the mask register 52. To do this, each byte is monitored in turn by AND circuit 74 which operates together with a Write Enable signal on line 76 to write a "1" bit for each "FF" detected and a "0" bit for all other codes, at the corresponding position in the mask register 52. Thus, at the completion of the first string move, the mask register 52 contains a record of the positional distribution of all escape (FF) characters detected.

Now addresses of the third set are placed on address bus 66. Thus, the mask register 52 is put into "Write suppress mode" by operation of line 78 from decoder 70. A row of PC buffer 14 equivalent to the row in MFI buffer 12 just moved is moved to the row buffer 50. As each byte of buffer 14 is moved to the row buffer the positional bit in the mask register is read out. If a '0' bit is read out to AND 80 via line 82, buffer 12 contained a displayable character and the new write to the row buffer is suppressed, i.e. AND 80 is not enabled. If a '1' bit is read out then buffer 12 contained an ESC (FF) character and the new byte from buffer 14 replaces the ESC character in the row buffer 50.

Figure 4:
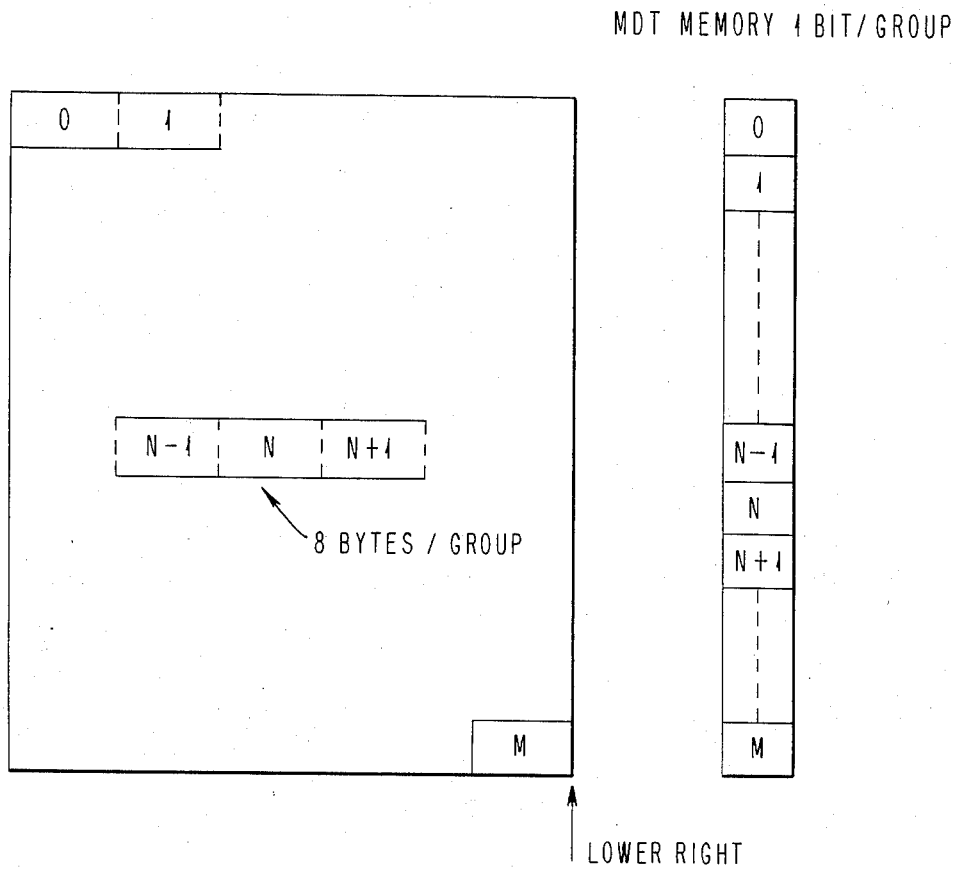
FIG. 4 depicts a modified data tag scheme for employment in the apparatus of FIG. 1 in accordance with an aspect of the invention.

At the completion of the second block move the line buffer contains the merged display data from buffers 12 and 14. As stated above, the use of the modified data tag (MDT) registers 60, 62 expedites the merger of data needed to update the display screen by elimination of unchanged rows. These MDT registers can be employed on a character row or less than row basis, as illustrated by FIG. 4.

In addition, performance can be enhanced if a second single bit register is used to record if any escape characters were encountered in the data from buffer 12. At the end of the move of buffer 12 this register would be read to determine if a move of buffer 14 is required. This register is shown at 84, FIG. 3.

Figure 5:
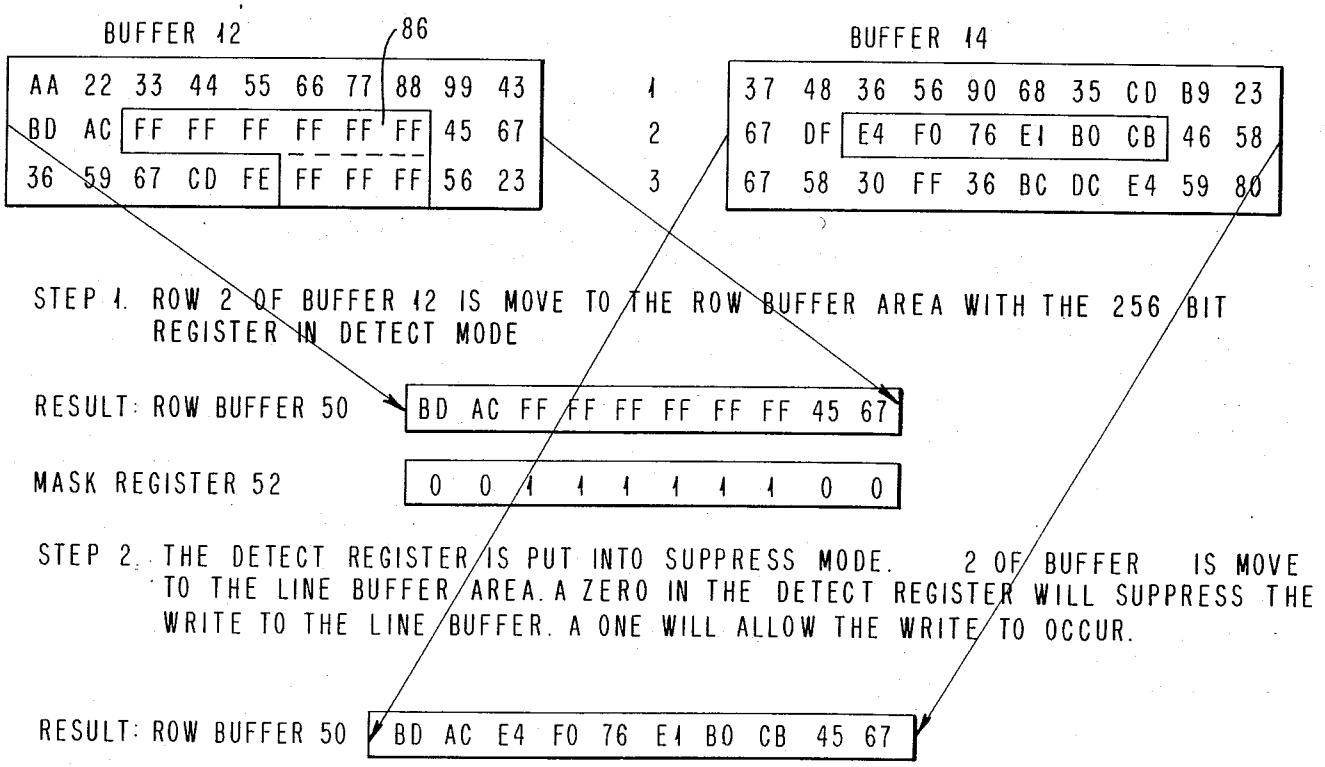
FIG. 5 is a diagrammatic representation of the data merging role of the buffer arrangement of FIG. 2.

FIG. 5 shows diagrammatically the steps of the above described data merge process. Operation on a segment of row 2 of buffers 12 and 14 is shown. A window 86 in the image to be displayed is to be filled with characters from the PC buffer 14. Thus a field of "FF" characters is present, in buffer 12, starting in row 2. When the row 2 segment is moved to the row buffer 50, the "FF" escape characters are recorded along with the valid character codes BD, AC, etc., and the mask register 52 contains the corresponding sequence of "0" and "1" bits. Then, when the corresponding row segment is read from PC buffer 14 to the row buffer 50 under the masking action of register 52, the FF's in row buffer 50 are over-written by the PC characters E4, F0, etc.

Figure 6:
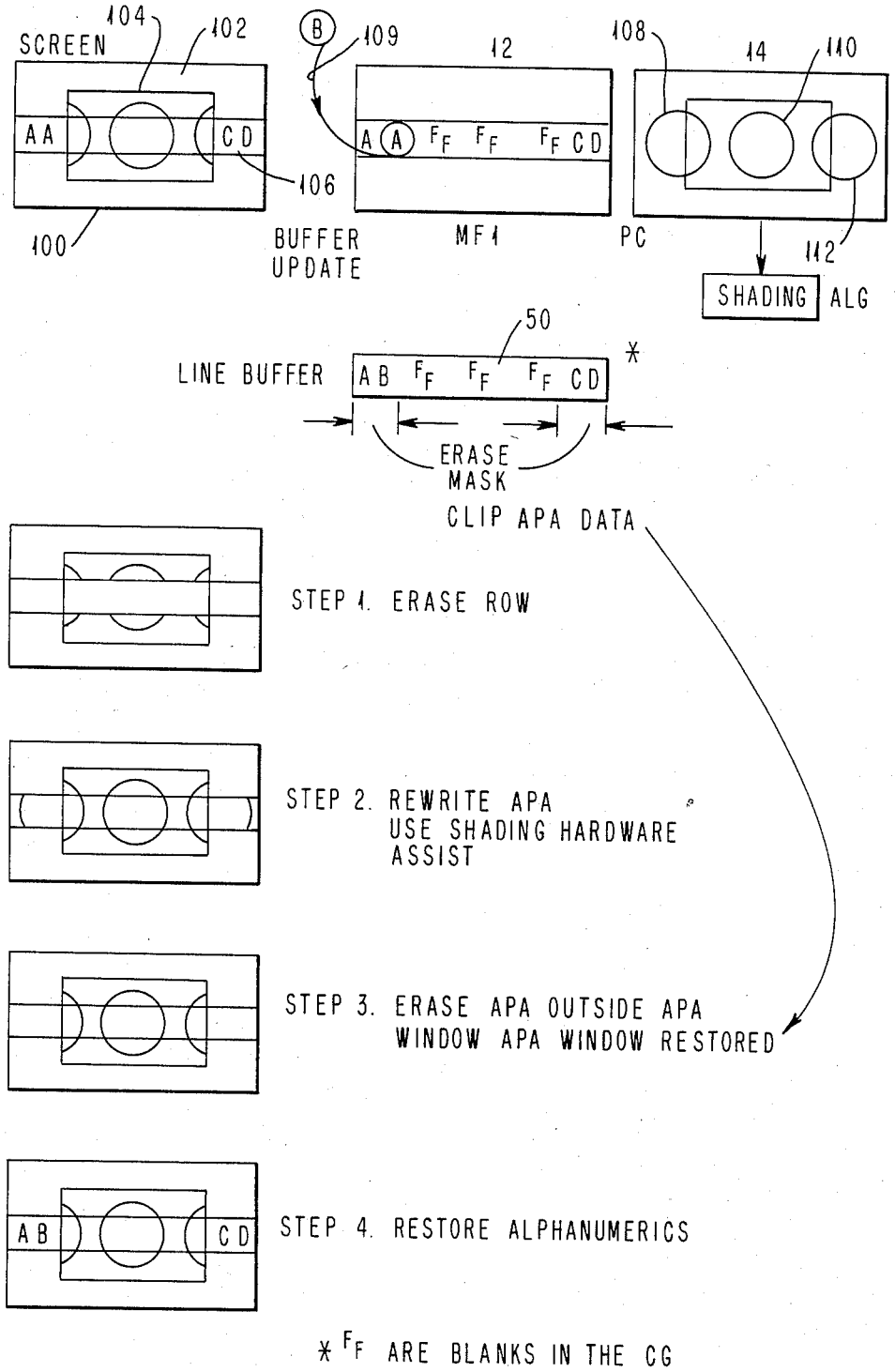
FIG. 6 illustrates the presentation of "all points addressable" graphic data within the scheme of the invention, utilizing two data bits per pel to yield a gray-shade effect.
Figure 7:
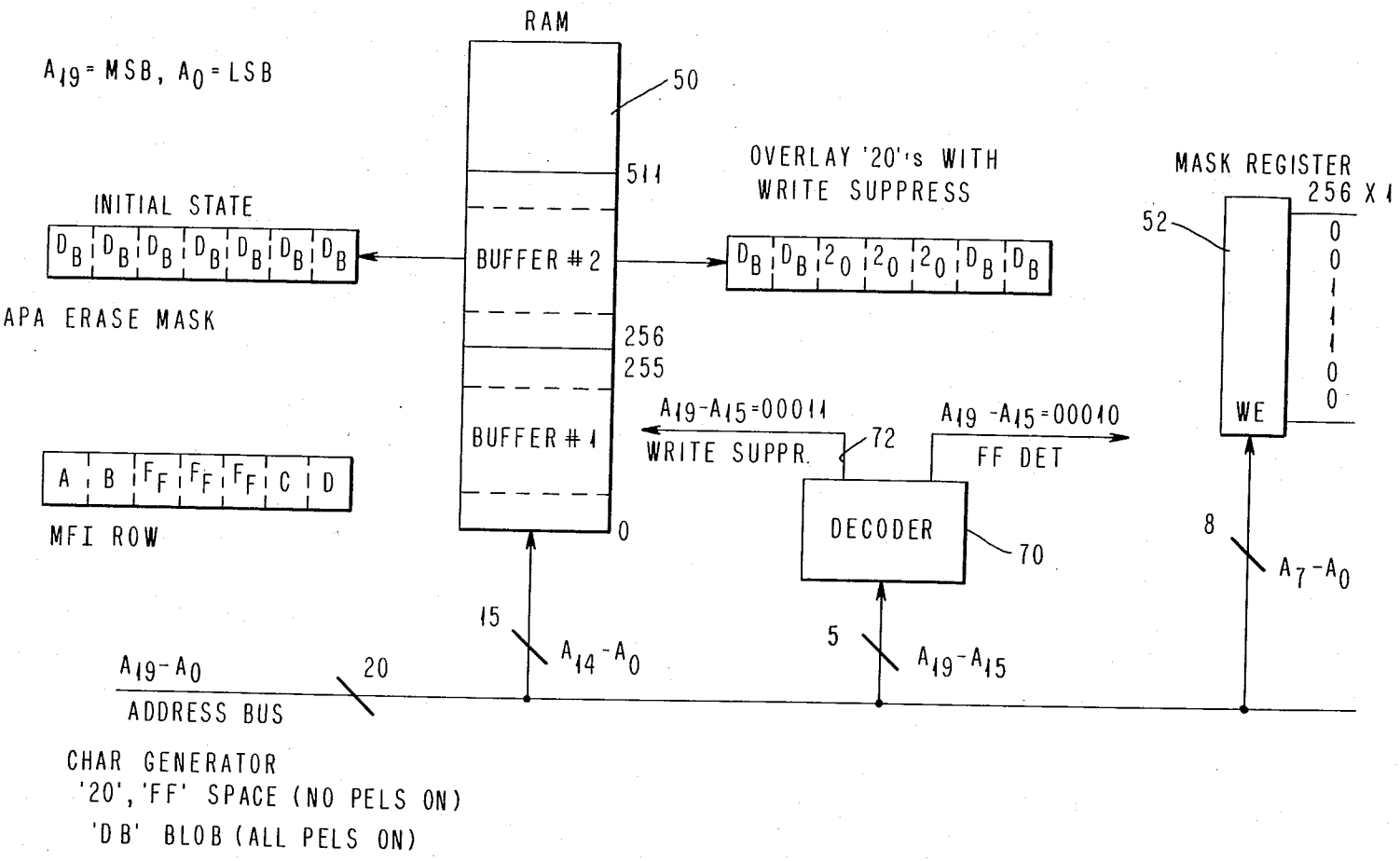
FIG. 7 shows the use of multiple row or swath buffers in connection with operations shown in FIG. 6.

As thus far described, the buffering and merging of coded characters has been emphasized. The PC 18, using commercially available programming, can also generate pel data for so-called "APA" graphics. Thus, the PC buffers 14 can contain bytes representative of picture elements (Pels) which can be on the basis of one bit per dot and one dot per pel, or can, for example be on a two bit, four dot per pel basis to provide shading capability. FIGS. 6 and 7 illustrate a preferred method of updating the display screen upon a change in the window content of a mixed MFI coded character and PC pel graphic screen picture. A segment of the screen is shown at 100, containing an MFI window 102 and a PC graphics window 104. In the illustration, for a given row 106, the screen shows actual characters AA - - - CD, so that the MFI buffer 12 contains codes for letters A, A, escape codes FF, and codes for letters C, D.

PC buffer 14 contains pel defining bytes for the same row which describe parts of circles 108, 110, 112. Let it be assumed that the second letter A in screen row 106 is to be changed to a letter B. Thus, the MFI buffer 12 is altered as indicated at 108 and the row buffer 50 (FIG. 3) would contain, before the merge operation, codes for A, B - - - C, D and intervening escape codes FF.

Now, instead of using the escape codes simply to merge data, they are used in a step-by-step fashion to control selective erase and write operations to update the screen, as shown by the diagrams in the figure.

FIG. 7 shows how this is accomplished and illustrates how buffer 50 uses two volumes of its space, buffers #1 and #2.

Step 1:

The area on the display screen associated with the MFI Row which has been loaded into the line buffer is erased. This is done by a full screen width swath erase function ("Clear Character" OP code) of the plasma panel adapter of FIG. 8.

Step 2:

Although the erased area is to contain a Mix of MFI characters and APA data, the APA data associated with the row is rewritten across the entire row without regard to window boundaries. This is done by a "Draw NCI" OP code of the plasma panel adapter which in effect gates pel data from buffer 130 one pel string at a time until the "character box" row across the screen is filled with a swath of graphics directly corresponding to the pel data in buffer 14 from which it was derived.

Step 3:

A Second Line Buffer is built with the character code for an all pels on "blob" character code. For the PC 18, 'DB' is a "blob". Next, with write under mask enable, the row processor 64 copies a blank row to buffer #2, by using blank characters. Using the Erase Char. Op. the adapter 15, using line buffer 2 will clip the APA data at the window edge. This clipping is on pel boundaries, so that there is no gap at the edges of the APA window.

Step 4:

Using Draw Char Op Code, the adapter 15, writes Line Buffer #1 to the Screen 8.

Figure 8:
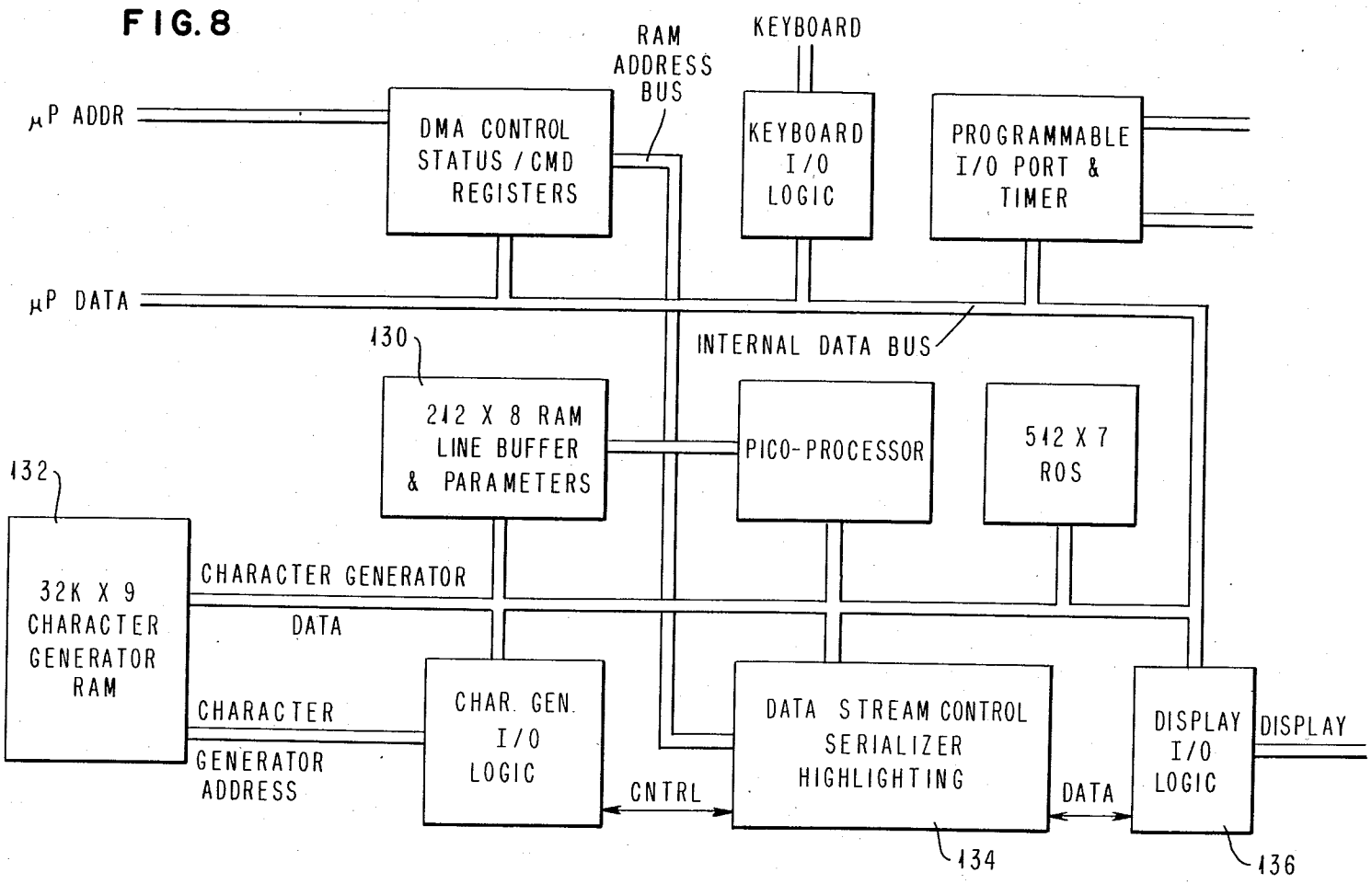
FIGS. 8 and 9 illustrate a plasma panel adapter organization and a plasma panel structure, respectively, suitable for employment in the scheme of FIG. 1.
Figure 9:
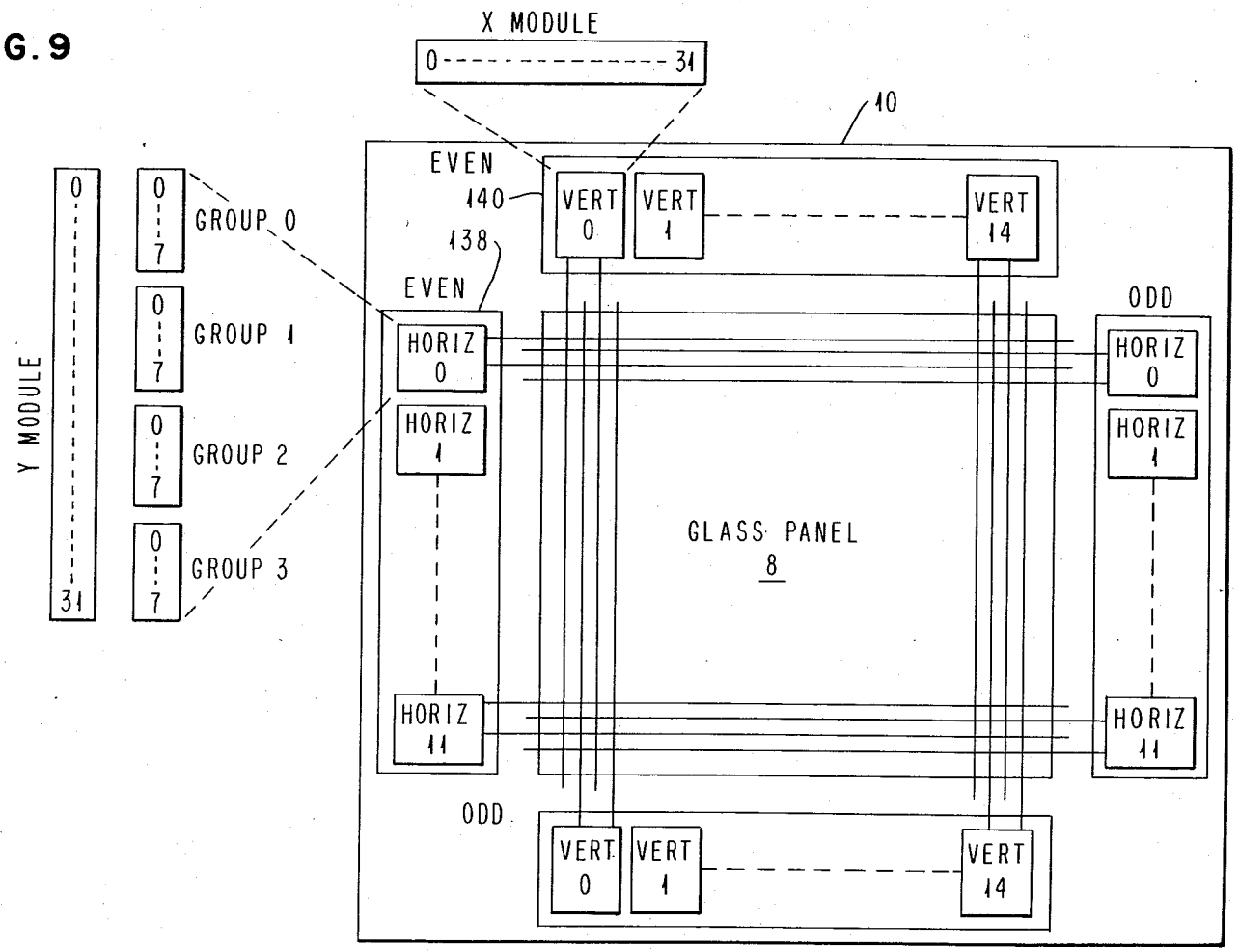

The operation of the plasma panel adapter 15 of FIGS. 1, 2 and 8 to accomplish this and other screen erase - write opeations will now be further described with reference to FIGS. 8 and 9. The adapter shown in FIG. 8 fetches data from the row buffer 50 and stores it in RAM 130 via a DMA move operation. Character codes thus provided act as addresses which point to bit sequences in the character generator 132 representative of the character pels to be displayed. These are assembled by serializer 134 as "slices" of strings of characters which are supplied, together with other needed signals, such as swath erase and write location select signals, by display I/O logic 136 conductor grid drive circuits 138, 140 of the plasma display unit 10 in known manner, such as described in more detail for example in the aforecited application Ser. No. 472,783.

In the case of non-coded pel graphics data, the character generator is by-passed and lines of pels are stored in the adapter buffer 130 and then supplied as such to the display unit, all in accordance with the erase and write sequence described with reference to FIG. 6.

What is claimed is:

1. A display system for providing image determining data from plural sources to a display device wherein one of the sources provides control codes signifying display screen locations at which data from the other source is to be utilized, comprising a buffer for receiving and storing data from said one source for a display on the screen of said display device, memory means arranged in operation to store indications of the existence and positions of said control codes in said data corresponding to positions of control codes in said buffer, and means arranged in operation for receiving and overwriting in said buffer data from the other said source, the writing being under control of said indications in said memory means.

2. A display system according to claim 1, wherein said system operates on one swath of the display at a time, said system further including means operatively associated with said one source to inhibit the overwriting operation as to those swaths which lack said control code.

3. A system in accordance with claim 1 or claim 2, wherein said display device is of a storage-type, further including means to select for potential overwriting only those data which include a display image change requiring a display screen storage update.

4. A system in accordance with claim 1, wherein said display device is of a storage-type and further including means to mix alphanumeric and pel graphic data for display, the mixing means being responsive to presence of said control codes in said buffer iteratively to erase and rewrite a swath of the display by (a) erasing the swath, (b) then writing graphic data from said other source throughout the swath, (c) then erasing the graphic data in the swath not corresponding to a said control code, and (d) then writing aphanumeric data from said buffer to portions of said swath lacking correspondence to a said control code.

5. A data display system having a display device and plural sources of display data accessible in a manner comparable with the generation of a display on the display device under partial control of the contents of a primary one of the sources in that, when that source outputs a control code instead of a data code, the data for the corresponding area of the display is accessed from the other source characterized in that:

(a) the display device is a storage-type display device in which the display is generated in swaths (b) a swath buffer interfacing the display data sources and the display device (c) a mask register arranged in operation to store indications of the existence and positions of said control codes in said data corresponding to positions of said control codes in said buffer, and (d) a control arranged in operation to load the swath buffer from the primary source, entering a counterpart mask element into the mask register per data or control code element for that swath and, thereafter, to cause the swath register to be overwritten where it contains control codes, under the control of the mask register content from the indicated other source.

6. A display system as claimed in claim 5 wherein the display data sources include means masking by swath, as to whether or not the display data in them has been changed, the control being arranged to select the sources for merging into the swath buffer only those swath equivalents indicating change.

7. A display system as claimed in claim 5 or claim 6 in which means are provided for causing pel data to bypass the swath buffer and character data only to be supplied to the swath buffer for potential merging.

8. A display system as claimed in claim 5 or claim 6 wherein the display data merge function is controlled via the addresses applied to the system, a decoder being provided to write the row and mask register in parallel in response to addresses in the first applied address space in the merge cycle, to write the row register under mask in response to addresses in the second applied address space in the merge cycle and to read the row register in response to addresses in the third applied address space in the merge cycle.

9. A display system as claimed in claim 8, in which means are provided for detecting the need or otherwise of invoking the address space potentially applied second in the merge-cycle.

* * * * *